United States Patent [19]

Hoffman et al.

[11] Patent Number: 4,749,967

[45] Date of Patent: Jun. 7, 1988

[54] HIGH FREQUENCY ELECTRICAL SWITCH

[75] Inventors: Jerzy Hoffman, Marina del Rey; George J. Maculewicz; Robert A. Sznuk, both of Los Angeles, all of Calif.

[73] Assignee: F L Jennings Division of F L Industries, Inc., San Jose, Calif.

[21] Appl. No.: 868,282

[22] Filed: May 28, 1986

[51] Int. Cl.[4] ..... H01P 1/10

[52] U.S. Cl. ..... 333/105; 200/153 S

[58] Field of Search ..... 333/102, 101, 105, 262; 335/4, 5; 200/153 S, 16 R, 16 C

[56] References Cited

U.S. PATENT DOCUMENTS

| | | | |
|---|---|---|---|
| 2,472,274 | 6/1949 | Beleskas | 333/105 |
| 2,958,054 | 10/1960 | Concelman | 333/105 |
| 3,036,282 | 5/1962 | Lanctot | 200/153 S X |
| 3,182,270 | 5/1965 | Horton | 333/105 |
| 3,208,011 | 9/1965 | McHenry | 200/153 S |
| 4,070,637 | 1/1978 | Assal et al. | 333/105 |
| 4,298,847 | 11/1981 | Hoffman | 333/105 |

*Primary Examiner*—Gene Wan
*Assistant Examiner*—Seung Ham
*Attorney, Agent, or Firm*—Bogucki, Scherlacher, Mok & Roth

[57] ABSTRACT

A low cost, vibration resistant high frequency switch includes a conductive housing having bores for receiving a center probe, first and second cantilevered side probes, a floating center contact and a dielectric control rod. The center probe includes an axial bore in one end which loosely receives a first end of the low mass, wire shaped axially extending center contact. Adjacent the opposite, second end of the center contact, free ends of the side probe are spaced in a longitudinal direction perpendicular to the axial direction and extend from opposite directions into overlapping relationship with the floating center probe positioned therebetween. A solenoid controls the dielectric control rod which engages the center contact approximately midway along its length to selectively force the second end into engagement with the first or second side contact while maintaining engagement between the first end of the center contact and the center probe.

26 Claims, 7 Drawing Sheets

BACK

TOP

FRONT

RIGHT SIDE

LEFT SIDE

BOTTOM

HIGH FREQUENCY ELECTRICAL SWITCH

BACKGROUND OF THE INVENTION

Electrical switches are among the oldest and most commonly used electrical components found in use today. In spite of many years of technological advancement and development, however, a need still exists to improve electrical and mechanical switch characteristics such as insertion loss, reliability, cross coupling, cost, physical size and upper signal frequency limit. Typically, attempts to improve one characteristic result in a tradeoff that impairs another characteristic. For example, if an attempt is made to reduce manufacturing cost by reducing size, the high frequency isolation or signal cross-coupling characteristic deteriorates and the insertion loss increases. There thus exists a need for continuing improvement in the design and manufacture of electrical switches.

Present day electrical switches typically utilize some kind of spring loaded center contact that may be flexed or otherwise moved between different contact positions to provide a desired switching arrangement. U.S. Pat. No. 2,958,054 to Concelman for "Impedance Terminated Coaxial Line Switch Apparatus" teaches a relay switch arrangement in which unconnected terminals are terminated in their characteristic impedance to reduce the voltage standing wave ratio (VSWR) and hence cross talk inducing signal magnitudes. In that patent, spring biased flexure members 23, 24 extend from opposite side conductors toward a center conductor where they are moved by actuator pins 31, 32 to engage either a center conductor or a termination resistor.

U.S. Pat. No. 3,182,270 to Horton for "Multiple Position Coaxial Switch With Angularly Spaced Radial Channels" discloses a multiple pole switch in which each side terminal is selectively coupled by a spring biased flexure element 23 to either a center contact or a terminating resistor under control of a relay coil. Such an arrangement has a relatively high parts count and hence high expense, is subject to component failure and does not have a geometric configuration that minimizes insertion loss or VSWR.

U.S. Pat. No. 4,070,637 to Assal et al. for "Redundant Microwave Configuration" teaches a microwave frequency switch arrangement in which any one of a plurality of terminals may be connected to any other terminal. The switch uses nonflexing strip line contacts which are free at each end and are moved into or out of contact with adjacent contact points. Each end of the moveable strip line center contact selectively engages or disengages a single contact point.

U.S. Pat. No. 4,298,847 to Hoffman for "Multiposition Microwave Switch With Independent Termination" teaches another multipole switch arrangement in which both ends disengage a corresponding fixed contact under control of a solenoid.

SUMMARY OF THE INVENTION

A low cost, rapid action, high frequency electrical switch in accordance with the invention includes a conductive housing with cylindrical bores therein for receiving corresponding switch components, a center probe and a center contact disposed within a center contact bore, first and second side contacts disposed within corresponding side contact bores, a spring biased dielectric control rod disposed within a control rod bore and a solenoid disposed to selectively actuate the control rod. A solenoid controls operation of the switch.

The center probe is an elongated cylindrical wire having an outer end providing an external switch coupling to either an SMA coaxial connector or a printed circuit board connection lead and an inner end with an axially extending bore therein. The center conductor is a cylindrical wire having a first end which fits loosely within the axial bore in the end of the center probe. The center contact extends past a central region of the housing and between overlapping longitudinally spaced, cantilevered ends of the first and second side probes to terminate in a second end.

The first and second side probes are cylindrical wires and have outer ends on opposite sides of the center contact which provide a terminal coupling to either SMA coaxial connectors or to leads which provide connection to a printed circuit board. The side probes extend in parallel relationship and generally perpendicular to the center contact from the outer ends to inner ends which overlap one another. The inner ends have sufficient overlap distance and are spaced sufficiently in the longitudinal direction to permit the second end of the center contact to pass between them.

The dielectric control rod is also cylindrical in shape and is disposed in a longitudinally extending control rod bore in the central region of the housing. The control rod is responsive to the solenoid and loosely engages the center contact by passing the center contact through a bore therein. The control rod engages the center contact at a central region thereof such that an upward force on the control rod forces the center contact in an upward direction until the second end of the center contact makes electrically conductive engagement with the second or upper side probe and the first end makes electrically conductive engagement with an upper portion of the axial bore in the center probe. Similarly, in response to a downward force the control rod forces the center contact downward until the second end engages the lower or first side probe and the first end engages a lower portion of the axial bore in the center probe.

In the disclosed arrangement a spring biases the control rod upwardly and the solenoid selectively overcomes the spring force to push the control rod and hence the center contact downward.

The relatively low mass of the center contact assures a rapid switch action as well as good vibrational characteristics. The loose fit floating arrangement of the first end of the center contact within the axial bore eliminates flexure of the center contact and thus eliminates fatigue failure and reduces the required actuation forces as well.

Placement of the conductive switch components within close fitting, but electrically isolated bores in the housing helps reduce cross talk and insertion loss while improving the voltage standing wave ratio (VSWR). Excellent isolation between the first and second side probes is achieved because of the longitudinal spacing between them, the relatively short distance by which they overlap and the shielding of the conductive bores which surround them. Isolation between the center contact and disengaged side probe is optimized by the perpendicular relationship between them which assures a very small overlap region and the shielding of the conductive bores except in the immediate vicinity of the contact region. To further improve shielding and minimize insertion losses the center contact bore has a generally conical shape with a larger diameter at the second end which undergoes substantial motion than at the first end which undergoes relatively little motion. To facilitate manufacture, the conical center contact bore is approximated by two cylindrical bores, a smaller diameter bore adjacent the first end and a larger diameter bore adjacent the second end. A switch in accordance with the invention has demonstrated satisfactory performance in a frequency range as high as 6–12 Gigahertz.

BRIEF DESCRIPTION OF THE DRAWINGS

A better understanding of the invention may be had from a consideration of the following Detailed Description, taken in conjunction with the accompanying drawings in which.

DETAILED DESCRIPTION

Figure 1:
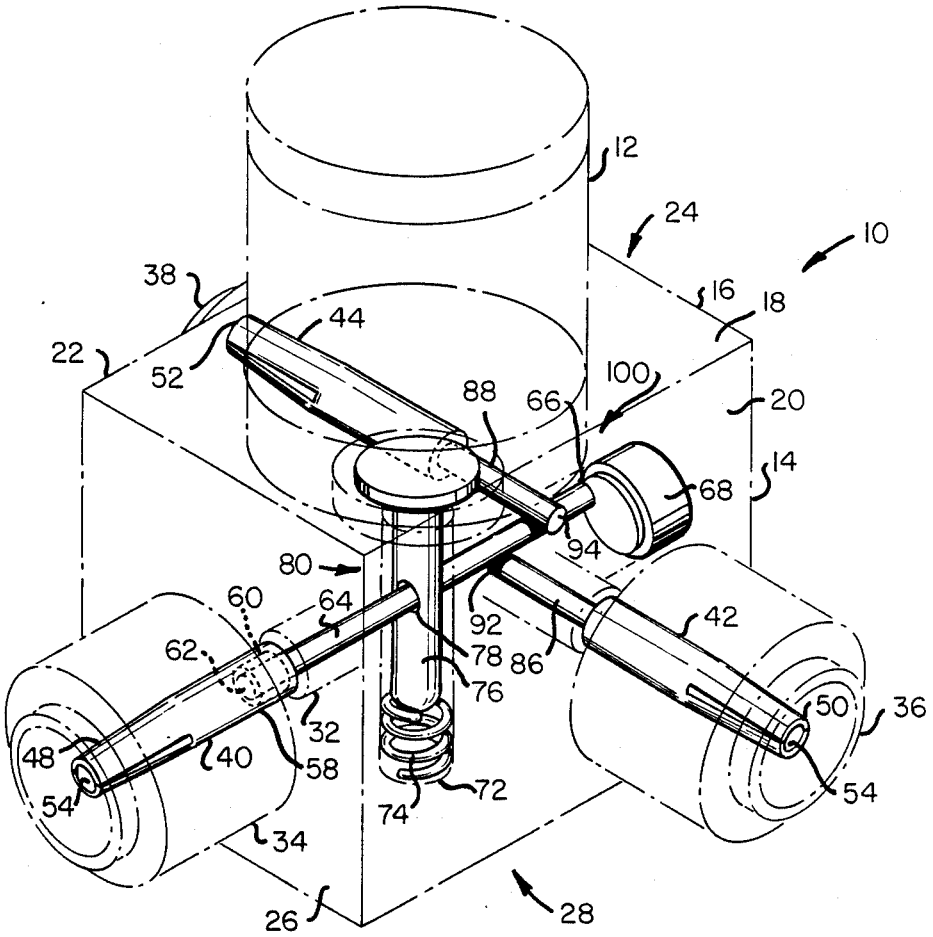
FIG. 1 is a simplified phantom perspective view illustrating the general configuration and operation of a high frequency electrical switch in accordance with the invention.

Referring now to FIG. 1, a low cost, high frequency electrical switch 10 in accordance with the invention includes a solenoid 12 of generally conventional construction which is shown in perspective phantom outline and a high frequency switch assembly 14. In FIG. 1, the switch assembly 14 is shown slightly schematized for the purpose of illustrating the configuration and operation of the invention and includes a solid aluminum housing 16 having a top surface 18, a right side 20, left side 22 which is not visible in FIG. 1, a back 24 which is not visible in FIG. 1, a front 26 and a bottom 28 is which not visible in FIG. 1.

The housing 16 has an axially extending center contact bore 32 which it extends all the way through the housing 16 from the front face 26 to the face 24. The axially extending center contact bore 32 is disposed approximately at the center of the front and rear faces 26, 24.

Three standard SMA coaxial connectors threadedly engage bores in three different surfaces of the housing 16 to provide external switch connections to signal conducting coaxial cables (not shown). A center connector 34 threadedly engages the front face 26, a first side or right side connector 36 threadedly engages the right side 20, and a second side or left side connector 38 threadly engages the left side surface 22 at a location that is longitudinally spaced upwardly of the right side connector 36. Stated differently, the left side connector 38 is closer to top surface 18 than is right side connector 36.

Each of the connectors 34, 36, 38 has a conductive outer shell containing a dielectric bead (not shown in FIG. 1) which in turn supports a concentrically, centrally mounted conductive probe. The center connector 34 supports a center probe 40, the right side connector 36 supports a right side or first side probe 42 and the left side connector 38 supports a left side or second side probe 44. Each of the probes 40, 42, 44 has a first or outer end 48, 50, 52 respectively which is slotted and crimped to provide a resilient, force engaging contact upon receiving through a central bore 54 a center conductor of a connecting coaxial cable (not shown). An inner end 58 of center probe 40 has therein an axial bore 60 which receives a first end 62 of a cylindrical wire center contact 64. Center contact 64 extends through the center contact bore 32 to a second end 66 which terminates adjacent the back surface 24 but within the housing 16. A dielectric plug 68 closes the center contact bore 32 at the back surface 24 and serves to confine the center contact 64 within the center contact bore 32 between plug 68 and axially bore 60.

A longitudinally extending control rod bore 72 receives a cylindrical compression spring 74 and a dielectric control rod 76 which is upwardly biased by the compression spring 74. The dielectric control rod 76 has an actually extending centrally located bore 78 through which center contact 64 passes with a central region 80 of center contact 64 loosely engaging the control rod bore 78.

The first and second side probes 42, 44 are substantially identical and include in addition to the oppositely positioned outer ends 52, 54 cylindrical wire contact portions 86, 88 respectfully which are candidly supported and extend towards one another in parallel, longitudinally spaced relationship to terminate at overlapping inner ends 92, 94 respectfully at a switch contact region 100. Center contact 64 passes between the overlapping ends 92, 94 in switch contact region 100 and with second end 66 being disposed slightly there beyond.

With the solenoid 12 inactive, compression spring 74 forces control rod 76 in an upward direction. Control rod 76 in turn forces the center region of center contact 64 in an upward direction. Because control rod 76 is approximately centrally located along center contact 64, the upward force thereon is approximately evenly distributed between the first and second ends. At the first end, center contact 64 moves upwardly until it engages an upper portion of axial bore 60. At the second end 66, the center contact moves upwardly until it engages a lower portion of the inner end 94 of second side probe 44. A conductive electrical contact is thus created between the second side probe 44 and center probe 40 through center contact 64.

However, if solenoid 12 is actuated to generate a downward force which overcomes the upward force of spring 74, dielectric control rod 76 moves downwardly and forces in turn center contact 64 in a downward direction. Under this circumstance, the first end 62 engages a lower portion of axial bore 60 while the opposite second end 66 is downwardly forced into engagement with a top portion of contact 86 of first side probe 42. Under this circumstance an electrical connection is made from first side probe 42 through center contact 64 to the center probe 40. By constraining the first end of center contact within the center probe end bore and the central portion within the bore through control rod 76 the position of center contact 64 is fully defined except for motion in the axial direction which is further constrained by a plug.

Figure 2:
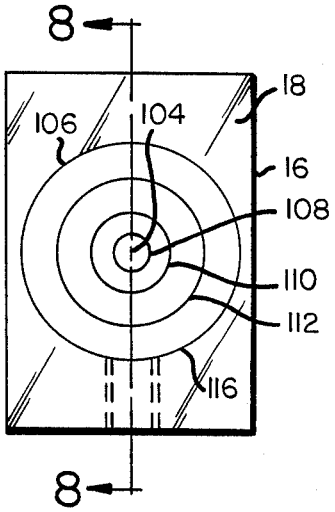
FIG. 2 is a top view of a housing for the switch shown in FIG. 1.
Figure 6:
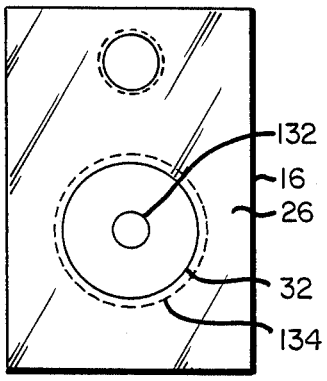
FIG. 6 is a front view of the housing shown in FIG. 2.
Figure 7:
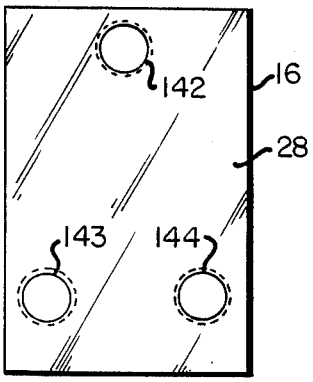
FIG. 7 is a bottom view of the housing shown in FIG. 2.
Figure 8:
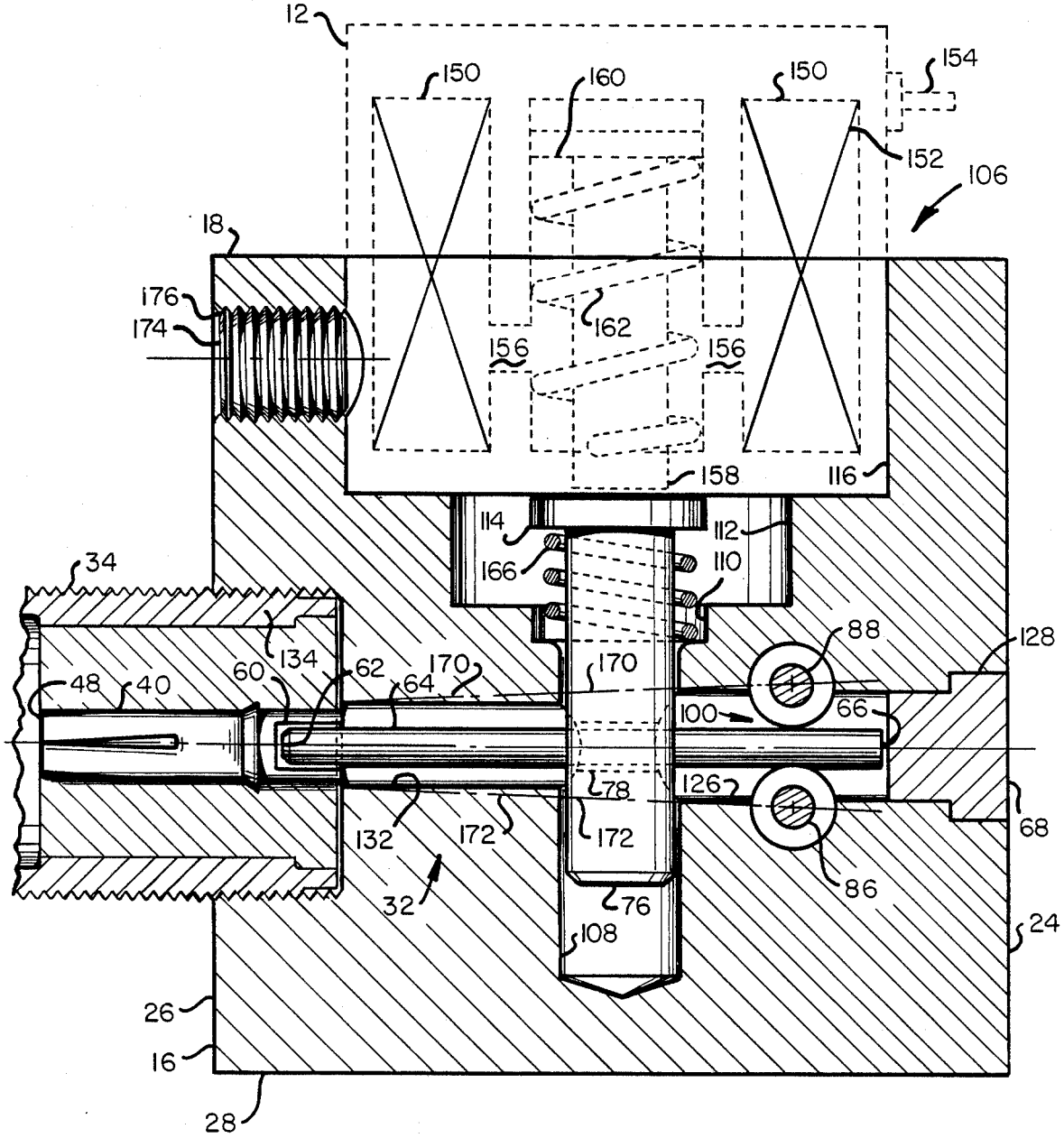
FIG. 8 is a partially sectional, partially phantom view of the switch shown in FIG. 1, taken along line 8—8 with respect to the housing as shown in FIG. 2.

Referring now in general to FIGS. 2–8 and particularly to FIGS. 2 and 8 as viewed from the top, the housing 16 is 0.430 inches wide, 0.600 plus or minus 0.002 inch deep, 0.600 inch high and is rectangular in configuration. A longitudinally extending control rod bore extends through the top surface 18 toward but not to the bottom surface 28 at an axial center point 104 which is centered within the top surface 18 at 0.300 inch behind the front surface 26 and 0.215 inch left of the right side surface 20. The control rod bore 106 has a plurality of varying diameters at different depths within the housing 16. The deepest and smallest diameter section 108 has a diameter of 0.086 inch plus 0.001 minus 0.000 and is drilled to a depth of 0.530 inch from the top surface 18. A spring retainer section 110 of control rod bore 106 is a cylindrical counter bore having a maximum depth of 0.28 plus or minus 0.003 inch relative to the top surface 18 and a diameter of 0.125 inch. A head receiving section 112 of control rod bore 106 receives a head portion 114 of control rod 76 and has a diameter of 0.250 inch with a maximum depth of 0.255 plus or minus 0.003 inch relative to the top surface 18. The largest diameter and uppermost section of control rod bore 106 is a solenoid section 116 which matingly receives and supports the solenoid 12.

Figure 3:
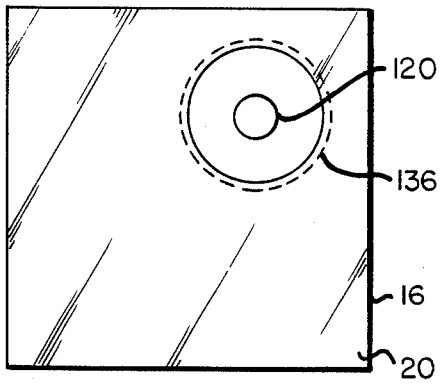
FIG. 3 is a side view of the housing shown in FIG. 2, taken from the right side.
Figure 4:
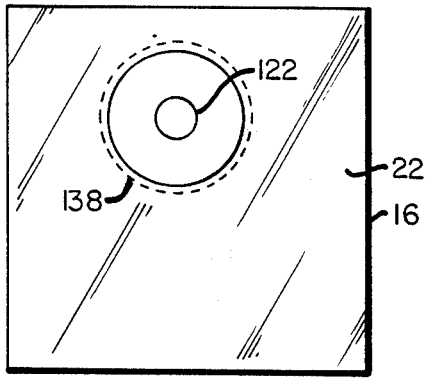
FIG. 4 is a side view of the housing shown in FIG. 2, taken from the left side.

Referring now more particularly to FIGS. 3 and 4, first and second side probe bores 120, 122 enter the housing 16 from the right and left side respectively with a diameter of 0.0625 plus or minus 0.030 and preferably 0.0010 inch to a depth of 0.280 inch from each respective right and left side, 20, 22. Each of the side probe bores 120, 122 has a central axis located 0.175 plus or minus 0.002 inch forward of the back surface 24. Although the two bores are aligned in the back to front direction, they are longitudinally spaced in the updown direction with their center points being located relative to a locating plane which is 0.240 plus or minus 0.002 inch above the bottom surface 28 and passes through the central axis of center contact bore 32. The first or right side bore 120 is located 0.042 plus or minus 0.001 inch below the reference plane while the second or left side bore 122 is located the same distance above the reference plane to provide a nominal center to center spacing of 0.084 inch in the longitudinal direction. For proper operation the center to center spacing should have a tolerance of plus or minus 0.050 inch and preferably of 0.025 inch.

Figure 5:
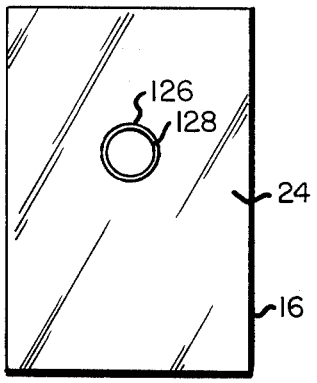
FIG. 5 is a back view of the housing shown in FIG. 2.

Referring now more specifically to FIGS. 5 and 6, the axially extending center contact bore 32 includes a plurality of cylindrical, coaxial sections of different diameters and depths. All are concentrically positioned along a center point axis which is located 0.240 plus or minus 0.002 inch above the bottom surface 28 and 0.215 plus or minus 0.003 inch leftward of the right side surface 20.

From the back surface 24 a contact zone section 126 of center contact bore 32 is drilled with a diameter of 0.078 plus or minus 0.030 and preferably 0.001 inch to a depth of 0.30 inch while a plug counter bore section 128 has a diameter of 0.094 plus or minus 0.001 inch and a depth of 0.060 plus or minus 0.003 inch.

From the front surface a first end section 132 of center contact bore 32 is drilled with a diameter of 0.0625 plus or minus 0.030 and preferably 0.001 inch to a depth sufficient to engage the larger diameter contact zone section 126. A connector mounting counter bore 134 has a diameter of 0.221 inch with a depth of 0.095 plus or minus 0.002 inch and is tapped with ¼-36 UNS-2B standard threads. For receiving the center SMA connector 34. Similarly, the right side probe bore 120 and left side probe bore 122 have identical counter bores 134, 138 for receiving SMA coaxial connectors 36 and 38 (shown in FIG. 1).

Referring more specifically to FIG. 7, the bottom surface 28 has three longitudinally extending threaded bores 142, 143, 144 therein to facilitate screw mounting of the switch 10 at any desired location. Each of the bores 142–144 is tapped with 2–56 UNC-2B standard threads to a depth of 0.16 inch.

Referring now to FIG. 8, it will be appreciated that the conventional solenoid 12 is represented in a simplified and schematic form as including a winding 150, a lead 152 coupling the winding 150 to external connection terminals 154 a magnetic gap 156 and a magnetic plunger 158 having an enlarged head 160 which interacts with magnetic forces generated by gap 156 to tend to force plunger 158 downward when the windings 150 are energized. A dielectric spring 162 maintains an upwardly directed bias force on the plunger 158.

It will be appreciated that for convenience of illustration, the center contact 64 is shown in an unstable central position midway between the right and left side probes 86, 88. Normally, while the windings 150 are in a deenergized state, spring 162 forces plunger 158 upward to an upper limit while a cylindrical coil spring 166 forces control rods 176 upwardly until center contact 64 engages the upper or left side probe contact section 88. Upon energization of solenoid 12, the plunger 158 is forced downward into engagement with a top surface of control rod 76 thereby forcing control rods 76 downward until the center contacts 64 engages the lower or right side probe contact section 86. It will be appreciated that the bore 78 through control rod 76 receives the center contact 64 and thereby constrains the control rod 76 and center contact 64 to move substantially together with a lose but close fit coupling between them. At the same time, the first end 62 of center contact 64 is contained with an axial bore 60 in center probe 40 and the second end 66 passes between the right and left side probe contact section 86, 88 to be constrained by plug 68.

As center contact 64 moves up and down within center contact bore 32 it is desirable that the center contact bore 32 maintain a substantially uniform spacing along the length thereof. Inasmuch as the second end 66 experiences greater motion than the first end 60, the center contact bore 132 ideally has a generally conical shape indicated in dashed outline by lines 170, 172. Manufacturing cost considerations suggest that the conical bore be approximated by two or more cylindrical sections such as the sections 132, 126. A set screw 174 threadedly engages a set screw bore 176 in the front surface 26 of housing 16 to secure the solenoid 12 within the solenoid counter bore 116.

Figure 9:
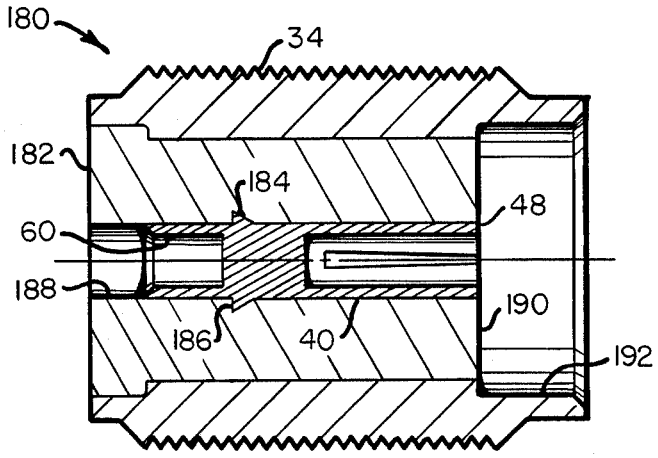
FIG. 9 is a sectional view of a center probe connector assembly used in the switch shown in FIG. 1 and taken along an axial plane.

Referring now to FIG. 9, there is shown a center probe assembly 180 including the standard SMA threaded connector shell 34, a teflon dielectric bead 182, and the center probe 40. The center probe 40 has an overall length of 0.220 plus or minus 0.003 inch and an outside diameter of 0.050 plus or minus 0.015 and preferably 0.001 inch except in the vicinity of a barb 184 which has a maximum diameter of 0.068 plus or minus 0.002 inch with an outward extending 30° chamfer. The perpendicular surface 186 of barb 184 is located between 0.158 and 0.159 inch from the outward end 48. The axially extending bore 60 has a diameter of 0.031 plus or minus 0.015 and preferably 0.001 inch and a depth of between 0.050 and 0.055 inch. The Teflon bead 182 has an axially extending bore 188 therethrough with a diameter between 0.048 and 0.050 inches. Bead 182 is sufficiently resilient to receive the center probe 40 therethrough including the barb 184. The outward end 48 of center proble 40 is aligned with the outward end 190 of bead 182 and both are aligned with the bottom of a cylindrical counter sink bore 192 having a diameter of between 0.181 and 0.183 inch and a depth between 0.075 and 0.077 inch relative to the outward end of shell 34.

Figure 10:
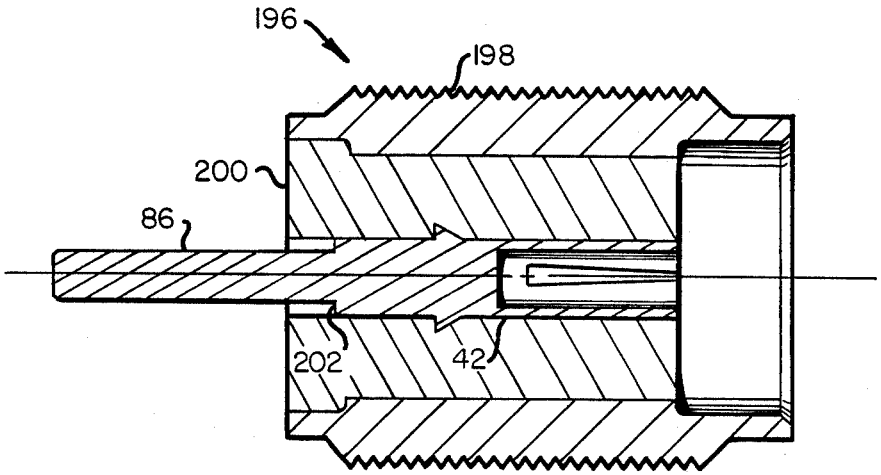
FIG. 10 is a sectional view of a side probe connector assembly used in the switch shown in FIG. 1 and taken along an axial plane.

Referring now to FIG. 10, the left and right side probe assemblies are identical and are consequently described in conjunction with a single right side probe assembly 196 having an outer aluminum shell 198 identical to the center probe shell 34 and a teflon dielectric bead 200 that is identical to bead 182 of center probe assembly 180. Right side probe 42 is made of berylium copper and the outer end of right side probe 42 is identical to the outer end of center probe 40 up to a transition region 202 except that the right hand side probe 42 does not have an axially extending bore in the inner end thereof. At the transition region 202 the diameter of right side probe 42 decreases from 0.068 plus or minus 0.002 inch to 0.031 plus or minus 0.015 and preferably 0.001 inch at a contact section 86 at the inner end of right side probe 42. The contact section of 86 has a nominal axial length of 0.190 inch and the overall length of right side probe 42 is between 0.407 and 0.410 inch. The center conductor receiving bore in the outer end of right side probe 42 has a diameter of 0.038 plus or minus 0.001 inch and a depth between 0.120 and 0.130 inch. The slot has a thickness of 0.006 plus or minus 0.001 inch to a depth of 0.150 inch. The end is diametrically compressed to close the slot at the outer end.

The center contact 64 is a cylindrical rod having a length of 0.445 plus or minus 0.003 inch with a diameter of 0.0254 inch corresponding to number 22 wire. The tolerance on the diameter is between plus or minus 0.015 inch inclusive and preferably closer. The center probe 40, right side probe 42, left side probe 44, and center contact 64 are all made of berylium copper alloy. When assembled, the contact sections 86, 88 of the right and left side probes 42, 44 overlap each other by approximately 0.040 inch in the vicinity of the switch contact region 100 with a tolerance which is preferably between plus or minus 0.015 in inclusive. If the overlap is too small, the center contact 64 may fail to make proper contact with one of the side probes 42, 44. On the other hand, if the overlap between the two side probes 42, 44 becomes greater than necessary to assure proper contact, the cross talk produced by switch 10 becomes unnecessarily large.

Figure 11:
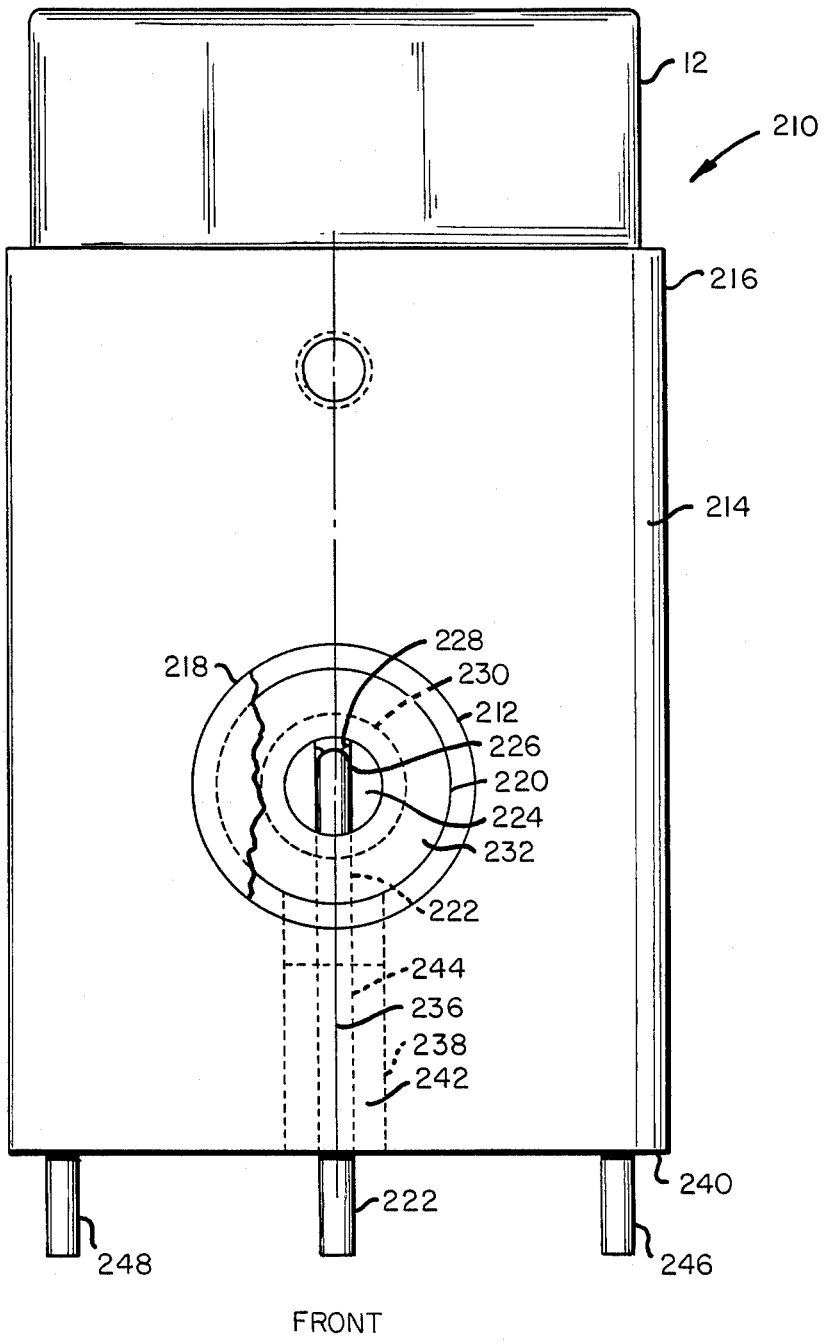
FIG. 11 is a front plan view, partly broken away of an alternative embodiment of a high frequency electrical switch in accordance with the invention.

Referring now to FIG. 11, there is shown an alternative embodiment of a high speed electrical switch 210 which is similar in structure and operation to the switch 10 except that printed circuit board leads are brought out through the bottom of the housing 216 in lieu of the coaxial connectors, 40, 42, 44. As shown in FIG. 11, an axially extending largest diameter bore 212 is formed in the front surface 214 of housing 216 with a diameter of 0.187 plus or minus 0.001 inch and depth of 0.030 plus or minus 0.003 inch. The outer cylindrical counter sink bore 212 receives a dielectric cover plug 218 which is disk shaped and shown broken away in FIG. 11. A 0.156 plus or minus 0.001 inch diameter access bore 220 is cut to a depth of 0.160 plus or minus 0.003 inch from the front surface 214 to provide access of soldering equipment to a joint between a printed circuit board lead 222 and a center probe 224. Center probe 224 has a vertically or longitudinally extending slot 226 which receives an upper end of printed circuit bore lead 222 and is joined thereto by a solder joint 228. The access bore 220 receives a 0.055 to 0.057 inch thick disk shaped teflon bead 232 which is positioned in the bottom of bore 220 and has a central cylindrical aperture which receives and supports the center probe 224. An isolation counter bore 230 has a diameter of 0.094 plus or minus 0.001 inch and a depth of 0.015 inch below the depth of counter bore 220 to provide dielectric isolation between the conductive aluminum housing 214 and the center probe 224.

The printed circuit board lead 222 is disposed concentrically with a longitudinally extending central axis 236 which is disposed to pass through the axis of center probe 224 at a depth of approximately 0.087 inch behind front face 214. A printed circuit lead bore 238 has a diameter of 0.0625 inch and extends from a bottom surface 240 upward into the counter bore 220. A dielectric Teflon bead 242 has a cylindrical axially extending bore 244 which receives and supports the printed circuit board lead 222 within bore 238 and in alignment with slot 226 of the outer end of center probe 224.

In similar manner, the right and left side probes (not shown) are connected to right and left side printed circuit board leads 246, 248.

Figure 12:
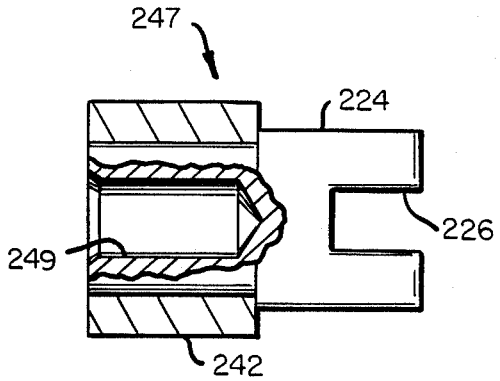
FIG. 12 is a plan view, partly broken away of a center probe assembly used in the switch shown in FIG. 11.

The center probe assembly, 247 is shown in greater detail in FIG. 12 and includes the dielectric Teflon bead 242 and the center probe 224 having an aperture or slot 226 in the outer end thereof for matingly receiving a printed circuit board lead for soldering thereto. The inner end of center probe 224 has an axially extending end bore 249 therein with a diameter of 0.031 plus or minus 0.015 and preferably 0.001 inch and a depth of 0.050 to 0.055 inch.

Figure 13:
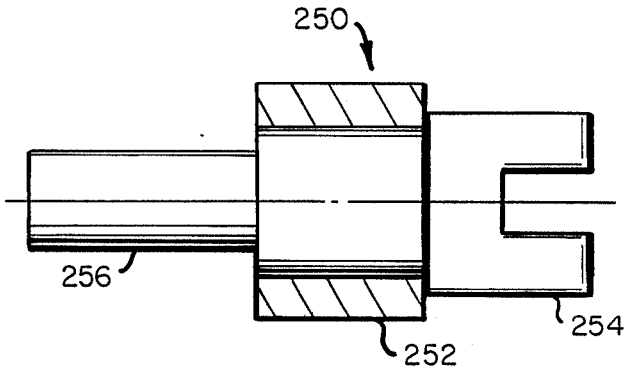
FIG. 13 is a plan view, partly broken away of a side probe assembly used in the switch shown in FIG. 11.

The right and left side probe assemblies are identical and therefore representatively shown in FIG. 13 by right side probe assembly 250 including a dielectric teflon bead 252 and a slotted side probe 254. The outer portion of side probe assembly 250 is identical to center probe assembly 247 except that side probe 254 contains no axially extending bore on the inner end thereof and instead connects to an inwardly extending contact section 256 which is cylindrical in shape with a diameter of 0.031 plus or minus 0.015 and preferably 0.001 inch and an axial length of 0.075 plus or minus 0.002 inch. The overall length of side probe 254 is 0.185 plus or minus 0.003 inch.

While there have been shown and described above various arrangements of high speed, high frequency electrical switches in accordance with the invention for the purpose of enabling a person skilled in the art to make and use the invention, it will be appreciated that the invention is not limited thereto. Accordingly, any modifications, variations, or equivalent arrangements within the scope of the attached claims should be considered to be within the scope of the invention.

What is claimed is:

1. A high frequency switch comprising:

a conductive housing having a longitudinally extending control rod bore, a center contact bore extending transversely to and intersecting the control rod bore, first and second longitudinally spaced side probe bores disposed in communication with the center contact bore at locations spaced in a given direction from the control rod bore;

first and second conductive side probes disposed respectively within the first and second side probe bores, the first and second side probes being electrically insulated from the housing and extending into the center contact bore;

a conductive center probe disposed within the center contact bore on a side of the control rod bore opposite the side probe bores, the center probe having a bore that opens toward the control rod bore;

a conductive center contact disposed within the center contact bore and electrically insulated from the housing with a first end extending into the center probe bore in loose fitting relationship thereto and an opposite second end extending past the control rod bore and at least to and between the first and second side probes; and a dielectric control rod disposed within the control rod bore and in engagement with the center contact at a central location between the first and second side probes and the center probe, the control rod being responsive to externally supplied forces to tend to longitudinally move the center contact between a first position wherein the center contact makes electrically conductive contact with the center probe adjacent the first end and electrically conductive contact with the first side probe adjacent the second end and a second position wherein the center contact makes electrically conductive contact with the center probe adjacent the first end and electrically conductive contact with the second side robe adjacent the second end.

2. A high frequency electrical switch according to claim 1 wherein the center probe is an elongated rod having in one end thereof the center probe bore.

3. A high frequency electrical switch according to claim 1 wherein the center probe is an elongated cylindrical rod extending along a central axis and having in one end thereof the center probe bore extending in an axial direction.

4. A high frequency electrical switch according to claim 1 wherein the center contact bore has a smaller diameter on a side of the control rod bore adjacent the first end of the center contact than on a side of the control rod bore adjacent the second end of the center contact.

5. A high frequency electrical switch according to claim 1 further comprising a solenoid connected to selectively move the control rod between the first and second positions in response to a selection control signal.

6. A high frequency electrical switch according to claim 1 further comprising a spring element biasing the control rod toward the first position and a solenoid connected to move the control rod to the second position in response to a control signal.

7. A high frequency electrical switch according to claim 1 further comprising an SMA center connector secured to the housing and receiving the center probe as a center conductor thereof and first and second SMA side connectors secured to the housing and receiving as center conductors the first and second side probes respectively.

8. A high frequency electrical switch according to claim 1 wherein the center contact is wire having a diameter between 0.0104 and 0.0404 inch inclusive, wherein the center probe has a bore having a diameter between 0.016 and 0.056 inch inclusive for receiving the first end of the center contact and wherein the first and second side probes each have a diameter between 0.016 and 0.056 inch inclusive and a center to center spacing between 0.059 and 0.109 inch inclusive in the vicinity of the center contact.

9. A high frequency electrical switch according to claim 1 wherein the center contact bore has a diameter between 0.0325 and 0.0925 inch inclusive on a side of the control rod bore adjacent the center probe and a diameter between 0.048 and 0.108 inch inclusive on a side of the control rod bore adjacent the side probes, the diameter being smaller on the side adjacent the center probe than on the side adjacent the side probes.

10. A high frequency electrical switch according to claim 9 wherein the center contact bore has a smaller diameter on a side of the control rod bore adjacent the center probe than on an opposite side adjacent the side probes.

11. A high frequency electrical switch according to claim 8 wherein the first side probe, second side probe, center contact and center probe are each made of beryllium copper.

12. A high frequency electrical switch according to claim 11 wherein the housing is made of aluminum.

13. A high frequency electrical switch according to claim 1 further comprising three longitudinally extending leads and three longitudinally extending bores through the housing for receiving the three leads respectively, the leads protruding from a bottom surface of the housing and making electrical contact with the housing with respectively the first side probe, second side probe and center probe.

14. A high frequency electrical switch according to claim 13 wherein the first side probe, second side probe and center probe each have an apertured outer end terminated within the housing which outer end matingly receives a respective one of the three leads.

15. A high frequency electrical switch according to claim 1 wherein the center contact is No. 22 (0.254 inch nominal diameter) wire, wherein the center probe has a 0.031 inch nominal diameter bore for receiving the first end of the center contact and wherein the first and second side probes each have a 0.031 inch nominal diameter and a center to center spacing of 0.084 inch nominal in the vicinity of the center contact.

16. A high frequency electrical switch according to claim 15 wherein the inner ends of the left and right side probes overlap each other through a distance of 0.040 inch plus or minus 0.015 inch.

17. A high frequency electrical switch according to claim 15 wherein the left and right side probes, center probe and center contact are made of beryllium copper.

18. A high frequency electrical switch according to claim 1 wherein the center contact bore has a 0.0625 inch nominal diameter on a side of the control rod bore adjacent the center probe and a 0.078 inch nominal diameter on a side of the control rod bore adjacent the side probes.

19. A high frequency electrical switch according to claim 15 wherein the center contact bore has a smaller diameter on a side of the control rod bore adjacent the center probe than on a side of the control rod bore adjacent the side probes.

20. A high frequency electrical switch comprising:

a rigid support structure;

an elongated conductive first side probe having a first end rigidly secured to the rigid support structure and extending from the first end to an opposite second end;

an elongated conductive second side probe having a first end secured to the rigid support structure and extending from the first end to an opposite second end, the second side probe having a contact region adjacent the second end thereof that is in overlapping but spaced apart relationship to a contact region adjacent the second end of the first side probe;

a conductive center probe secured to the rigid support structure and having a concavity therein;

an elongated conductive center contact having a first end nonrigidly constrained within the concavity of the center probe and extending between the contact regions of the first and second side probes to a second end opposite the first end; and a dielectric position control member disposed in engagement with the center contact between the first and second probes on one side and the concavity on the other side, the control member being moveable between a first switch position wherein the first end of the center contact is in engagement with the center probe within the concavity and the second end is in engagement with the contact region of the first side probe and a second switch position wherein the first end of the center contact is in engagement with the center probe within the concavity and the second end is in engagement with the contact region of the second side probe.

21. An electrical switch comprising:

means for defining first and second conductive walls about respectively first and second generally cylindrical, longitudinally spaced side probe bores which have an overlapping contact zone at interior ends thereof;

first and second elongated side probes centrally disposed within the first and second side probe bores with interior ends disposed in an overlapping parallel spaced relationship;

means for defining conductive walls about a generally conical center contact bore having a central axis passing between the overlapping ends of the first and second side probes, the center contact bore having a larger diameter end adjacent the first and second side probes and a smaller diameter end spaced apart therefrom;

an elongated center probe having an apertured end disposed at the smaller diameter end of the center contact bore;

an elongated center contact having a first end loosely disposed within and constrained by the aperture end of the center probe and an opposite second end passing between the overlapping ends of the first and second side probes; and means engaging the center contact between the side probes and the center probe for longitudinally moving the center contact between electrical contact engagement with the first side probe and electrical contact engagement with the second side probe to complete an electrical circuit between the center probe and the selected one of the first and second side probes.

22. An electrical switch according to claim 21 wherein the longitudinally moving means comprises a longitudinally extending dielectric control rod having an aperture therethrough and wherein the center contact passes through the control rod aperture to provide positioning engagement between the center contact and the control rod.

23. An electrical switch according to claim 22 wherein the longitudinally moving means further comprises a solenoid connected to longitudinally move the control rod.

24. An electrical switch according to claim 21 wherein the generally conical center contact bore includes a smaller diameter cylindrical bore adjacent the smaller diameter end and a larger diameter cylindrical bore adjacent the larger diameter end.

25. A high frequency electrical switch comprising:

a rigid support structure;

an elongated conductive first side probe having a first end rigidly secured to the rigid support structure and extending from the first end to an opposite second end;

an elongated conductive second side probe having a first end secured to the rigid support structure and extending from the first end to an opposite second end, the second side probe having a contact region adjacent the second end thereof that is in overlapping but spaced apart relationship to a contact region adjacent the second end of the first side probe, the first and second side probes having their first ends disposed on opposite sides of the contact region with only the contact regions being in overlapping relationship to increase the high frequency isolation between the first and second side probes;

a conductive center probe secured to the rigid support structure and having a concavity therein;

an elongated conductive center contact having a first end nonrigidly constrained within the concavity of the center probe and extending between the contact regions of the first and second side probes to a second end opposite the first end; and a dielectric position control member disposed in engagement with the center contact between the first and second probes on one side and the concavity on the other side, the control member being moveable between a first switch position wherein the first end of the center contact is in engagement with the center probe within the concavity and the second end is in engagement with the contact region of the first side probe and a second switch position wherein the first end of the center contact is in engagement with the center probe within the concavity and the second end is in engagement with the contact region of the second side probe.

26. An electrical switch comprising:

means for defining first and second conductive walls about respectively first and second generally cylindrical, longitudinally spaced side probe bores which have an overlapping contact zone at interior ends thereof;

first and second elongated side probes centrally disposed with the first and second side probe bores with cylindrical interior ends disposed in an overlapping parallel spaced relationship;

means for defining conductive walls about a generally conical center contact bore having a central axis passing between the overlapping ends of the first and second side probes, the center contact bore having a larger diameter end adjacent the first and second side probes and a smaller diameter end spaced apart therefrom;

an elongated center probe having an apertured end disposed at the smaller diameter end of the center contact bore;

an elongated cylindrical wire center contact having a first end loosely disposed within and constrained by the aperture end of the center probe and an opposite second end passing between the overlapping ends of the first and second side probes; and means engaging the center contact between the side probes and the center probe for longitudinally moving the center contact between electrical contact engagement with the first side probe and electrical contact engagement with the second side probe to complete an electrical circuit between the center probe and the selected one of the first and second side probes.

* * * * *

UNITED STATES PATENT AND TRADEMARK OFFICE

CERTIFICATE OF CORRECTION

PATENT NO. : 4,749,967

DATED : June 7, 1988

INVENTOR(S) : Hoffman et al

It is certified that error appears in the above-identified patent and that said Letters Patent are hereby corrected as shown below:

Column 4, line 10, "threadly" should read "threadedly"

Column 6, line 54, "lose" should read "loose"

Column 8, line 11, after "inch and" insert --a--.

Column 10, line 48, "with" should read --within--.

Signed and Sealed this

Fourteenth Day of March, 1989

*Attest:*

DONALD J. QUIGG

*Attesting Officer*

*Commissioner of Patents and Trademarks*